US006336265B1

(12) United States Patent
Niedermair

(10) Patent No.: US 6,336,265 B1
(45) Date of Patent: Jan. 8, 2002

(54) COMPOSITE RAILROAD CROSS TIE AND METHOD OF MANUFACTURING SAME

(76) Inventor: Siegfried Niedermair, 52 Willowgrove Blvd., Sharon Ontario (CA), L0G 1V0

( * ) Notice: Subject to any disclaimer, the term of this patent is extended or adjusted under 35 U.S.C. 154(b) by 0 days.

(21) Appl. No.: 09/537,166

(22) Filed: Mar. 29, 2000

(30) Foreign Application Priority Data

May 5, 1999 (CA) ..... 2271238
Feb. 8, 2000 (CA) ..... 2298248

(51) Int. Cl.[7] ..... B23P 19/04
(52) U.S. Cl. ..... 29/460; 238/29; 238/83; 264/149; 264/171.11
(58) Field of Search ..... 29/460, 894; 238/29, 238/83, 84, 85, 95, 118; 264/171.11, 211.24, 149

(56) References Cited

U.S. PATENT DOCUMENTS

| | | | | | |
|---|---|---|---|---|---|
| 952,977 | A | * | 3/1910 | Case | 238/85 |
| 1,036,860 | A | * | 8/1912 | Kull | 238/84 |
| 1,041,736 | A | * | 10/1912 | Caldwell | 238/6 |
| 1,623,185 | A | * | 4/1927 | Hinde | 238/37 |
| 1,837,370 | A | * | 12/1931 | Pugal | 238/29 |
| 2,631,784 | A | | 3/1953 | Anderson | |
| 2,717,420 | A | * | 9/1955 | Roy | 264/119 |
| 3,289,940 | A | * | 12/1966 | Groff | 238/29 |
| 3,416,727 | A | | 12/1968 | Collins | |
| 3,598,312 | A | | 8/1971 | Hamilton | |
| 3,765,811 | A | * | 10/1973 | Sawada | 425/113 |
| 3,813,040 | A | | 5/1974 | Heinemeyer | |
| 3,893,619 | A | * | 7/1975 | Bruner | 238/83 |

(List continued on next page.)

FOREIGN PATENT DOCUMENTS

| | | | |
|---|---|---|---|
| EP | 0 154 259 | | 11/1985 |
| EP | 0 210 297 | A | 2/1987 |
| GB | 254 201 | A | 12/1925 |
| GB | 1439366 | | 6/1976 |
| GB | 2030621 | A | 4/1980 |
| WO | WO 95 02496 | A | 1/1995 |
| WO | WO 99 41065 | A | 8/1999 |

OTHER PUBLICATIONS

Australian Provisional Patent Application, Applicant: Avida Corporation, Filed: Dec. 19, 1990.
Database WPI—Section Ch, Week 197741 Derwent Publications Ltd., London, GB; Class A17, AN 1977–73287Y XP002161559 & JP 52 103465 A (Sumitomo Bakelite Co), Aug. 30, 1977.
Patent Abstracts Of Japan vol. 00/7, No. 159 (M–228), Jul. 13, 1983 & JP 58 067434 A (Shigeya Kuroda), Apr. 22, 1983.

* cited by examiner

*Primary Examiner*—S. Thomas Hughes
*Assistant Examiner*—Essama Omgba
(74) *Attorney, Agent, or Firm*—Riches, McKenzie & Herbert LLP

(57) ABSTRACT

A composite railroad cross tie supporting railroad track rails on a ballast or concrete roadbed is provided comprising an elongated wooden core, an end cap positioned over each end of the core and an outer shell or coating. The wooden core consists of virgin or recycled natural wood or of man made engineered wood such as oriented strand board (OSB), plywood, and the like. The outer coating can consist of virgin or recycled thermoplastic, thermoset resin, and/or rubber, with or without fillers or reinforcements. In manufacture, the core member is sized to a dimension which is less than the desired dimension of the finished composite cross tie. The end caps are then positioned over ends of the core member. Following the positioning of the end caps, the coating is applied to the core member in a continuous process by passing a series of core members with their end caps in a substantially end-to-end configuration through a cross head die.

8 Claims, 5 Drawing Sheets

U.S. PATENT DOCUMENTS 3,908,902 A 9/1975 Collins
4,034,913 A 7/1977 Hooper
4,083,491 A 4/1978 Hill
4,105,159 A * 8/1978 Brown ..... 238/36
4,150,790 A 4/1979 Potter
4,202,494 A 5/1980 Rumell
4,286,753 A * 9/1981 Lee ..... 238/37
4,355,754 A * 10/1982 Lund et al. ..... 238/83
4,416,419 A * 11/1983 Ohno ..... 238/89
4,832,588 A * 5/1989 Rasmussen ..... 425/114
4,955,839 A 9/1990 Kaschper
5,055,350 A * 10/1991 Neefe ..... 428/331
5,238,734 A * 8/1993 Murray ..... 428/292
5,489,402 A * 2/1996 Knoblauch et al. ..... 264/407
5,562,267 A * 10/1996 Heim et al. ..... 246/415 R
5,916,932 A * 6/1999 Nosker et al. ..... 523/204

COMPOSITE RAILROAD CROSS TIE AND METHOD OF MANUFACTURING SAME

RELATED APPLICATIONS

This application is related to the applicant's co-pending U.S. patent application Ser. No. 09/317,929 filed May 20, 1999.

SCOPE OF THE INVENTION

The present invention relates to an improved method of manufacturing a composite railroad cross tie, and more particularly a railway cross tie characterized by a core which is encased in plastic or resin.

BACKGROUND OF THE INVENTION

Conventionally, railway or railroad cross ties or "sleepers" have been formed from hardwood logs. The logs are cut into an elongated rectangular shape and typically have a width of between about 8 and 10 inches, a height of 6 to 8 inches, and a length of between about 7 and 9 feet. In use, the cross ties are positioned resting on a concrete rail bed or partially submerged within ballast such as crushed gravel or rock. Between about 20 and 40 cross ties are used to support each rail section of railroad track by driving spikes into the cross ties so that the spike heads engage a lower flange on each rail. Conventional hardwood railroad cross ties present disadvantages in that given the scarcity of hardwoods they are expensive to produce and susceptible to decay.

To prolong the life-span of hardwood railroad cross ties, it is known to coat or paint the sides and ends of hardwood cross ties with preserving chemicals, such as coal tar creosote or the like in an effort to delay their deterioration. The use of creosote as a preservative, suffers the disadvantage that it is a toxic substance and a suspected carcinogenic. Creosote coated cross ties therefore result in potential environmental hazards both in the initial coating of the cross ties, and through the possibility of the creosote leaching into the surrounding soil or water table.

When chemically treated with preservatives, hardwood cross ties will have a typical life span ranging from a maximum of about fifty years where optimum conditions and drainage occur, to as low as two years in high humidity environments. Even when cross ties are treated with decay inhibiting chemicals, the chemical preservatives will typically only penetrate between 2 and 10 mm into the ends and exterior surfaces of the cross tie. As the hardwood dries, it differentially shrinks with age. As a result of wood shrinkage, it is common for deep cracks or checks to form in the sides of cross ties and which may extend up to two inches into the cross tie surfaces. These cracks or checks in turn permit water and insects to reach the untreated interior portion of the wood, speeding the cross tie decay.

When repairing a rail section to replace cross ties which have deteriorated, it is often the practice to replace all of the cross ties along the entire rail section, regardless of whether or not even the majority of the hardwood cross ties may have deteriorated to such an extent as to be in need of replacement. Chemically treated hardwood railroad cross ties suffer a further disadvantage in that the toxic chemicals present a disposal difficulty for discarded cross ties, given environmental concerns over the hazardous chemical preservatives. As a result, it is frequently necessary to not only pay for new railroad cross ties, but also to pay a surcharge for the disposal of each railroad cross tie which is replaced.

In an attempt to overcome the disadvantages associated with conventional hardwood railroad cross ties, various individuals have proposed concrete, composite and manufactured cross tie constructions for use in place of hardwood logs. Concrete cross ties are very heavy, weighing as much as three times that of a hardwood cross tie, and are expensive to install. As well, concrete cross ties have a tendency to crack, and also take a heavy toll on the moving rail cars and cargo due to their lack of energy absorbing characteristics.

U.S. Pat. No. 4,150,790 to Potter, which issued Jun. 20, 1995 discloses a steel beam reinforced lignocellulosic cross tie. U.S. Pat. No. 4,083,491 to Hill, which issued Aug. 18, 1975 discloses a cross tie formed from two end blocks which are joined by a pair of metal sides. The manufactured sleepers or cross ties of Hill and Potter have not yet achieved commercial success as they are expensive to manufacture, and further they do not address the difficulties associated with the disposal of the millions of existing creosote impregnated hardwood cross ties which are currently in use.

U.S. Pat. No. 3,416,727 to Collins, which issued Dec. 17, 1968 discloses a laminated railroad tie formed from a shredded hardwood filler and synthetic resin made from waste wood. Collins suffers a disadvantage in that in addition to the added expense of manufacture, the use of shredded wood fiber may in fact increase the degradation of the cross tie. Plastic cross ties are very expensive, with the result that their use is restricted to areas which are difficult to access, such as tunnels, which are one of the most expensive areas for replacing cross ties and which offsets the high initial cost of plastic cross ties. Plastic cross ties are also usually made from polyolefine compounds which tend to stretch or elongate and creep under the heavy loads, particularly at elevated temperatures, which restricts their use. Like Hill and Potter, plastic based cross ties such as those proposed by Collins also do not address the problem of disposal of existing hardwood cross ties.

It has been proposed to provide a composite cross tie which consists of an inner core material of natural or engineered wood which is completely encased in an outer plastic shell. The inventors have appreciated, however, potential difficulties in the manufacture of coated core members. To ensure consistent finished cross tie dimensions, suggested methods of manufacture would involve injection molding the coating about each core. Injection molding is cost intensive from an equipment and tooling point of view. This process also shows relatively long cycle times in manufacturing due to the relatively thick layer of plastic needed to encapsulate the core.

SUMMARY OF THE INVENTION

The present invention overcomes at least some of the disadvantages of prior art railroad cross ties by providing a composite cross tie having an inner core member encased in plastic or resin. The coating layer is applied to the inner core by passing the core member through an enlarged die head which is configured to form an extrusion coating about the core in substantially the desired finished dimension.

Another object of the invention is to provide an improved method of forming a composite railroad cross tie to permit its manufacture quickly and economically in a continuous extrusion process.

The ends of the ties can be coated by resin provided in the extrusion process or by separate end caps either molded prior to the extrusion process or after the extrusion process.

The present invention also seeks to overcome the disadvantages associated with the prior art by providing an improved railroad cross tie or "sleeper", which has a water impermeable outer coating or shell to provide enhanced resistance to decay.

Another object of the invention is to provide a composite railroad cross tie which is characterized by an inner core member of natural or engineered wood, and extruded outer plastic coating layer or a pair of end covers or caps, which together with the coating layer substantially isolate the core from moisture and/or insects which may otherwise speed its decay. These end caps can be added to the core before or after the extrusion process.

Another object of the invention is to provide a railway or railroad composite cross tie which may be easily and economically manufactured, and which has a core formed from new or recycled hardwood, engineered woods, concrete, plastic composites or other such structurally suitable materials.

Another object of the invention is to provide a composite railroad cross tie which has substantially the same dimensions as a conventional creosote treated hardwood cross tie, so as to facilitate the replacement of worn hardwood cross ties partially submerged within rail bed ballast.

A further object of the invention is to provide an improved method of manufacturing a composite railroad cross tie having substantially the same stability, weight and physical properties as a new conventional hardwood cross tie.

Another object of the invention is to provide a composite railroad cross tie having a rectangular wooden interior core member which is enveloped at each of its ends by extruded plastic or resin or a separate end cover or cap, and along its longitudinal length by an outer coating of thermoplastic, thermosetting resins and/or rubbers or mixtures thereof, and in which the coating has a thickness selected so as not to interfere with the insertion and gripping of a conventional rail spike into the inner wooden core member.

The present invention provides a composite railroad cross tie which is characterized by an elongated core member, one and preferably two end covers or caps and a coating layer or shell. The end caps may be formed from a number of materials such as plastic, resins, metals, glass, as well as composites or mixtures thereof, and the outer coating layer is most preferably a thermoplastic or thermosetting resin.

Preferably, the core member is formed from new, recycled or engineered wood and is completely encased or enveloped by the end caps and outer coating, so as to be substantially sealed thereby from moisture, the atmosphere and insects. The core may be formed from hardwood or alternately engineered man-made wood products including by way of non-limiting examples plywood, micro laminates, oriented strand board and the like. The inner wooden core member preferably has a generally rectangular shape, however, other core profiles are possible.

The end covers are positioned over each end of the core member with the outer coating layer provided along the length of the core member to substantially encase the core member and provide the railroad cross tie with the desired dimensional profile.

In manufacture, the core member is sized to a dimension which is less than the desired dimension of the finished composite cross tie. The end caps are then positioned over ends of the core member. Following the positioning of the end caps, the coating is applied to the core member in a continuous process by passing a series of core members with their end caps in a substantially end-to-end configuration through a shaping die and most preferably, a cross head die. As the core members are moved through the crosshead die, the coating material is applied thereto in a sufficiently liquid form to infill any nail or spike holes, cracks which may exist in the core material. The outer coating layer is extruded over the core with a thickness of at least about 0.4 mm, and most preferably between about 1 and 10 mm, so as not to interfere with the driving of a conventional rail spike therethrough into the core member.

Most preferably, the cross head die is configured so that the extruded composite railroad cross tie has an overall dimension and shape substantially corresponding to a conventional hardwood railroad cross tie.

Following emergence from the cross head die, the composite railway ties are separated from each other by breaking or cutting the extruded ties at the point of contact between the abutting end caps.

In a preferred embodiment, the core member is formed from recycling a discarded hardwood railway tie, and preferably a discarded railway tie which was originally treated with creosote or other wood preserving chemicals. To form the core member, the discarded railway tie is refurbished by reducing its size on all sides to expose fresh wood surfaces. The chemically treated side surfaces of the hardwood tie are removed by a saw, sanding, planing or other suitable means to the required depth in most cases between about 0.4 and 20 mm, allowing for the additional layer of coating material. In addition, material may be removed from each end of the discarded cross tie in most cases to a depth of between about 1 and 100 mm, since penetration of preserving chemicals and destruction by natural causes is typically greater at the cross tie ends.

The end caps most preferably have a peripheral dimension which substantially corresponds to that of the refurbished cross tie ends. Although not necessary, the end caps may optionally be secured to the ends of the core member by the use of adhesives by separate mechanical fasteners such as nails, clips, screws and the like, or either in a friction fit by the engagement of a mechanical fastening element integrally formed as part of the end cap.

The outer coating layer may be selected from a number of water impermeable compounds including thermoplastics, thermosetting resin, rubbers and mixtures thereof. The use of polyolefins, such as polyethylene as an outer coating is highly advantageous as these coatings will permit some natural expansion and contraction of the inner wooden core without splitting, and thereby maintain the wooden core member substantially sealed from the environment.

Accordingly, in one aspect the present invention resides in a generally rectangular composite railroad cross tie for use in replacing a conventional hardwood cross tie comprising, an inner wooden core member, said inner core member having a pair of end surfaces longitudinally elongated side surfaces extending from a first one of said end surfaces to the other second one of said end surfaces, a first end covering member secured to and substantially covering said first end surface, an outer coating layer substantially bonded to said side surfaces of said core member, said outer coating layer comprising plastic and having an approximate average thickness selected preferably at between about 0.4 mm and 20 mm, wherein said composite railroad cross tie has an overall dimension substantially corresponding to that of said conventional hardwood cross tie.

In another aspect the present invention resides in a composite railroad cross tie for supporting railroad track rails on a ballast or a concrete rail bed, comprising a generally rectangular wooden core member having longitudinally elongated side surfaces extending from a first member end to a second member end, a pair of end cap members each having a substantially modular construction and a complementary size to a corresponding one of said first and second ends, a first one of said end cap members being secured to said first end, and the second other one of said end cap members being secured to the second end, an outer coating layer substantially bonded to said side surfaces of said core member, said outer coating layer having an average thickness preferably of between about 0.4 mm and 20 mm and being selected from the group consisting of a thermoplastic, a thermosetting resin, and mixtures thereof, wherein said end cap members and said coating layer substantially seal said core member from the atmosphere.

In a further aspect the present invention resides in a method of manufacturing a composite railroad cross tie from a discarded hardwood railroad cross tie which has chemically treated side and end surfaces, a method of manufacturing a composite railroad cross tie using an extrusion die having an axially extending feed bore, a generally rectangular die opening aligned with said feed bore, and an extrudate distribution passage communicating with said die opening, the railroad cross tie characterized by:

a generally rectangular inner wooden core member having a longitudinally elongated side surface extending from a first core member end to a second core member end, an end cap member in sealing engagement with said first core member end, and a coating layer substantially bonded to said side surfaces, wherein said cross tie is formed by:

securing said end cap member to said first end, and moving said core member together with said end cap member axially through said feed bore and past said die opening while extruding molten extrudate from the distribution passage into the die opening and about the side surfaces of the core member, and wherein said extrudate is selected from a thermoplastic, thermosetting resin and mixtures thereof.

BRIEF DESCRIPTION OF THE DRAWINGS

Reference may now be had to the following detailed description taken together with the accompanying drawings in which.

DETAILED DESCRIPTION OF THE INVENTION

Figure 1:
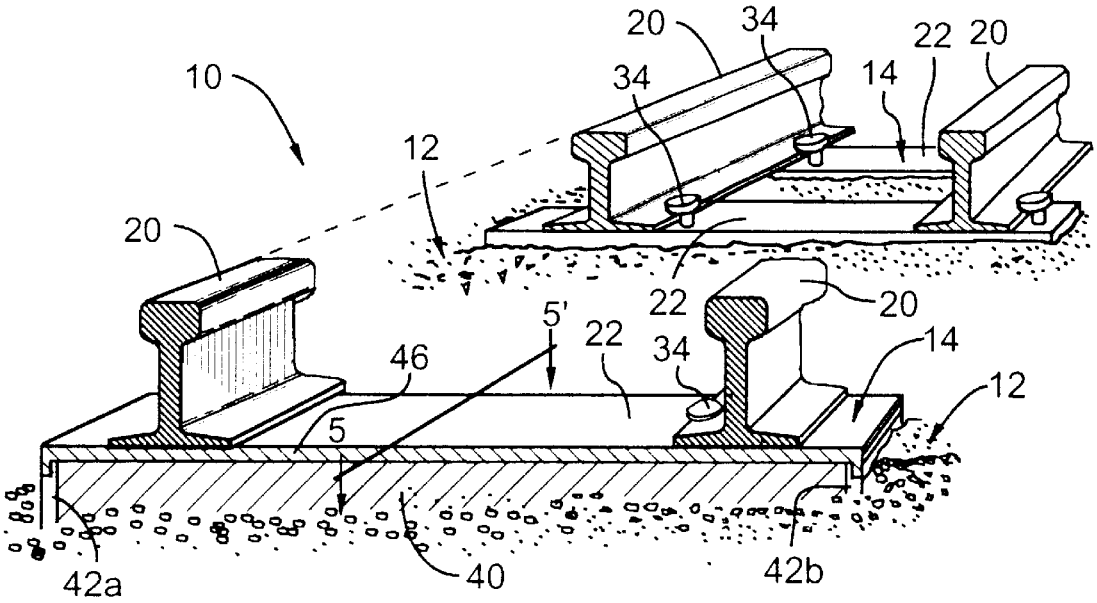
FIG. 1 shows a partially cutaway view of a composite railroad cross tie in position partially submerged within ballast and used to mount track rails in accordance with a preferred embodiment of the invention.
Figure 2:
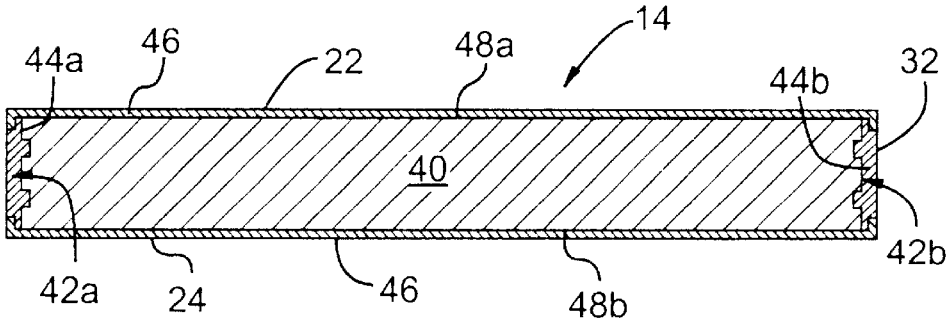
FIG. 2 shows a longitudinal cross-sectional view of the railroad cross tie shown in FIG. 1.

Reference is first made to FIG. 1 which shows a rail bed in accordance with a preferred embodiment of the invention. The rail bed 10 consists of a crushed gravel ballast base 12, a number of composite railroad cross ties 14 and a pair of railroad track rails 20. FIG. 2 shows best the railroad cross ties 14 as having a generally rectangular shape with elongated parallel upper and lower surfaces 22,24, side surfaces 26,28 (FIG. 5), and end surfaces 32,34. In use, the cross ties 14 are positioned in a parallel and spaced apart configuration partially submerged within the ballast 12 so that the upper surface 22 of each cross tie 14 is exposed. The two railroad track rails 20 are positioned in a parallel arrangement transversely across the upper surfaces 22 of the cross ties 14. The rails 20 are secured in place to the cross ties 14 driving a number of conventional rail spikes 34 or other holding devices into the cross ties 14 in a known manner.

Figure 5:
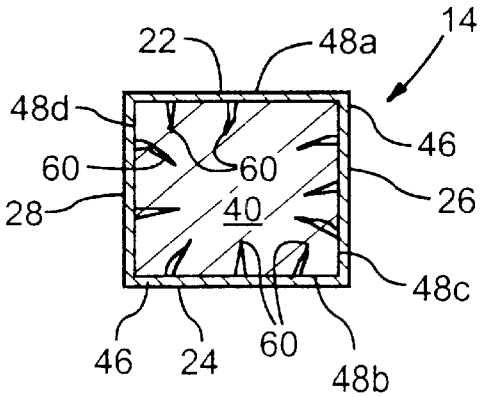
FIG. 5 shows a lateral cross-sectional end view of the cross tie shown in FIG. 1 taken along line 5—5'.
Figure 6:
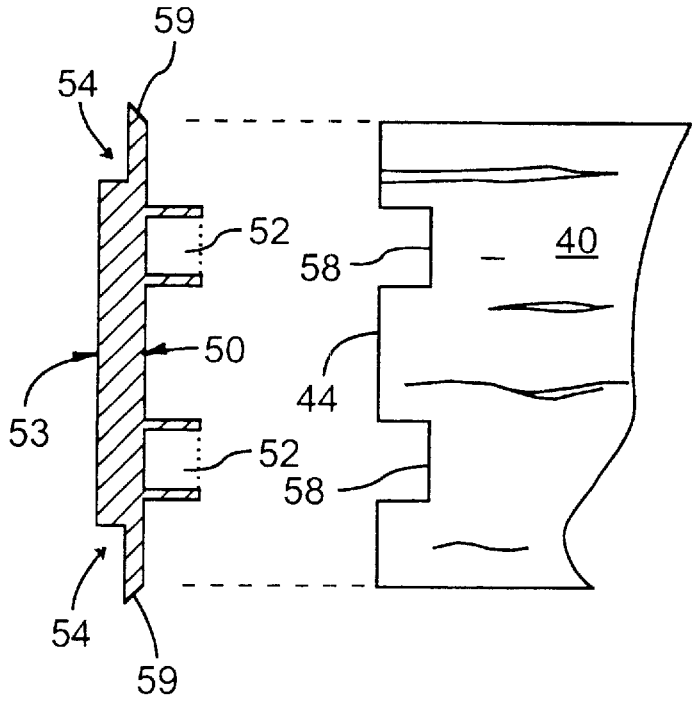
FIG. 6 shows an exploded cross-sectional view of an end cap and a hardwood core member in accordance with the preferred embodiment of the invention.

FIGS. 2, 5 and 6 show best the construction of each composite railroad cross tie 14 in accordance with a preferred embodiment of the invention. The cross ties 14 have an overall height of about 7 inches, a width of about 9 inches and a longitudinal length of about 8.5 feet, and generally correspond in dimension to a conventional hardwood cross tie (shown as 36 in FIG. 3). Each cross tie 14 includes a generally rectangular shaped hardwood core member 40, a pair of thermoplastic end covers or caps 42*a*,42*b* (FIG. 2), and an outer coating 46.

Figure 4:
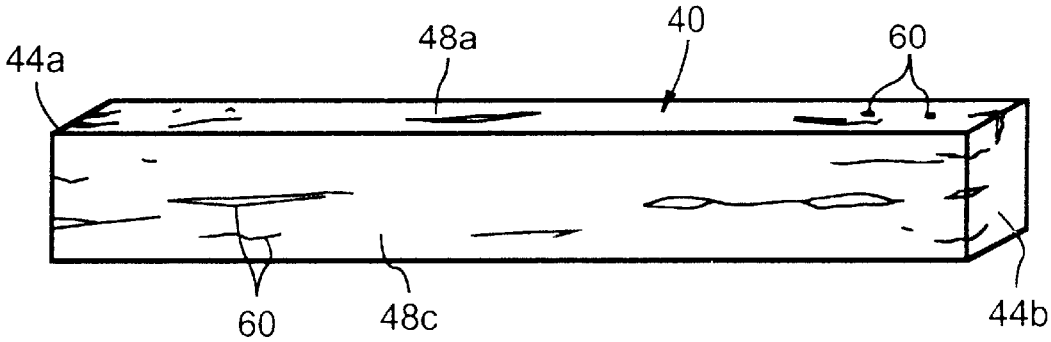
FIG. 4 shows a perspective view of a hardwood core member formed by refurbishing the cross tie of FIG. 3 by the removal of chemically preserved side and end surfaces.

FIGS. 4 and 5 show best the core member 40 as also having a generally rectangular profile with opposing pairs of parallel and longitudinally extending side surfaces 48*a*,48*b*, 48*c*,48*d* and parallel end surfaces 44*a*,44*b*. The core member 40 has a height and width which is approximately 0.8 mm to 40 mm smaller than the overall height and width of the cross tie 36, and an overall length which is approximately 2 to 200 mm shorter than the cross tie 36.

The core member is completely encapsulated by the end caps 42*a*,42*b* and outer coating 46, so as to be sealed from the atmosphere and/or any boring invertebrates or insects. The end caps 42*a*,42*b* are each secured to a respective longitudinal end 44*a*,44*b* of the core member 40.

Figure 7:
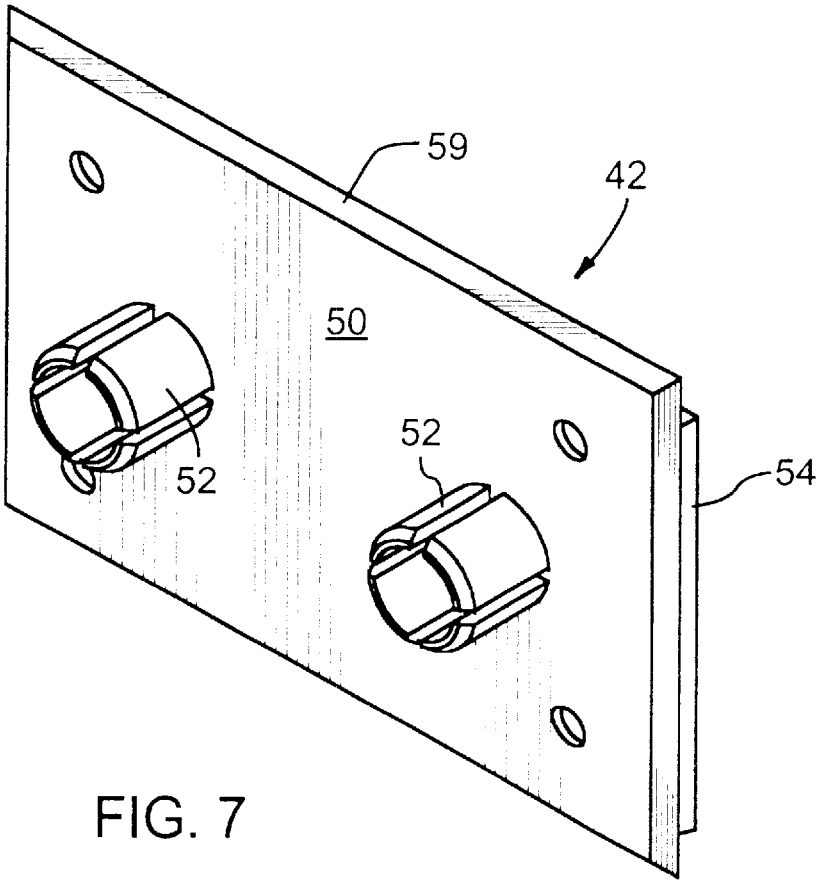
FIG. 7 shows a perspective view of the end cap of FIG. 6.

FIGS. 2, 6 and 7 show best the end cap 42 placement and construction in accordance with a preferred embodiment of the invention. Most preferably, each end cap 42*a*,42*b* is made from a thermoplastic or thermosetting resin and has the identical construction to permit their use interchangeably on either end 44*a*,44*b*. The end caps 42*a*,42*b* are formed having a peripheral dimension which is marginally greater than the dimension of the core ends 44*a*,44*b*, so as to substantially overly and cover each of the ends 44*a*,44*b* when secured thereto. FIGS. 6 and 7 show each end cap 42 best as having a generally planar contact surface 50 which is configured for abutting placement flush against the end 44. Although not essential, the outward surface 53 (FIG. 6) of the end cap 42 is preferably also planar and parallel to contact surface 50 and defines a shoulder 54. The shoulder 54 extends about the periphery of the end cap 42 spaced towards the outermost edge of the contact surface. A pair of bosses 52 project outwardly from the contact surface 50. The bosses 52 are sized to locate within complementary sized bore holes 58 (FIG. 6) formed in each core member end 44.

The engagement of the bosses 52 with the sidewalls of the bore holes 58 acts to secure each end cap 42*a*,42*b* over the respective core end 44*a*,44*b* with the contact surface 50 in juxtaposition with the end 44. The outermost edge of the contact surface 50 merges into a chamfered edge 59. As will be described, the chamfered edge 59 facilitates melting of the thermoplastic resin. The shoulder 54 is infilled with the coating 46 to provide enhanced sealing of the core member 40 from the atmosphere, as well as assisting in the retention of the end cap 42 over the core end 44. While FIGS. 6 and 7 illustrate each end cap 42 having two bosses 50, it is to be appreciated that fewer or greater number of bosses could be provided. Similarly, the bosses could be omitted in their entirety and the end cap 42 secured in place by an adhesive and/or mechanical fasteners such as nails and/or screws or by the coating 46 alone.

FIGS. 2 and 5 show best the coating layer 26 overlying the longitudinal side surfaces 48*a*,48*b*,48*c*,48*d* of the wooden core member 40. The outer coating 46 consists of a thermoplastic or thermosetting resin which as will be described hereafter, is the same as that used to form the end caps 42*a*,42*b*. The coating 46 is applied as a continuous layer over the longitudinally extending side surfaces 48*a*,48*b*,48*c*, 48*d* of the core member 40. The coating 46 is preferably a polyolefin and is applied to the core member 40 with a substantially constant even thickness over at least the top and bottom side surfaces 48*a*,48*b* of the core, and preferably also along front and back side surfaces 48*c*,48*d*. This advantageously ensures that any comprehensive forces caused by the passage of a train are evenly distributed vertically through the coating layer 46 and core member 40 to the ballast 12, minimizing the tendency of the core member 40 to move relative to the thermoplastic coating 46. As shown best in FIGS. 2 and 5, the coating layer 46 is applied to the hardwood core member 40 so as to bond directly to each of the side surfaces 48*a*,48*b*,48*c*,48*d* while infilling any nail holes, checks or cracks 60 which may have formed therein. Optionally, an adhesive or sealant may be pre-applied to the core member 40 to assist in the adhesion of the coating 46 thereto. FIG. 2 shows best the coating extending beyond the core ends 44*a*,44*b*, so as to cover the peripheral edge of each end cap 42*a*,42*b* and infill and overly the shoulders 54 thereon.

The manufacture of the cross tie is best described with reference to FIGS. 3, 4 and 8. A number of identically sized core members 40 are formed having a uniform predetermined size. The predetermined core size is selected so that each resulting wooden core member 40 is free from most of the creosote preservative, however, its refurbished side surfaces and ends will still show cracks, holes and other imperfections caused by aging wood shrinkage, as well as the previous use of spikes and nails. It is to be appreciated that although not essential, material is removed from each of the side and end surfaces of the discarded cross tie 36, so that the resulting refurbished core member 40 maintains substantially the identical sidewall and endwall orientation as that of the original recycled hardwood cross tie 36. More preferably, the hardwood cross tie 36 is reduced in size by the same height and width along each of its longitudinal sides.

Figure 3:
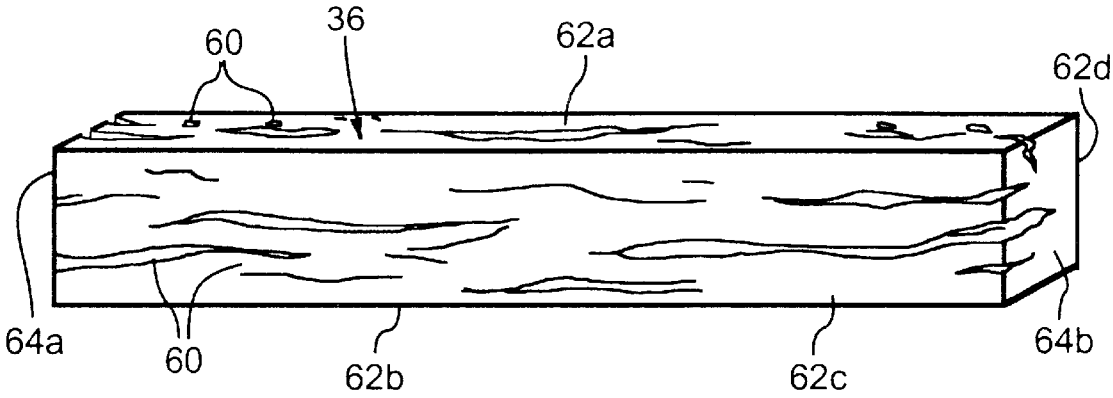
FIG. 3 PRIOR ART
FIG. 3 shows a perspective view of a discarded hardwood cross tie prior to refurbishing for use with the present invention.

The wooden core members 40 are initially formed by recycling and refurbishing discarded conventional chemically preserved hardwood railway cross ties 36 (FIG. 3). The discarded cross ties 36 are first reduced in size at all of their dimensions (length, height, width). Chemically treated surfaces are removed from the longitudinal sides 62*a*,62*b*,62*c*, 62*d* (FIG. 3) of the railway tie 36 to a depth of between about 1 and 10 mm, and which is sufficient to substantially remove the outermost layer of wood which has been impregnated by the creosote or other chemical preservatives. Material is also removed from each end 64*a*,64*b* of the discarded cross ties 36 to a greater depth (typically between about 1 and 100 mm) since chemical penetration is typically greater at the cross tie ends. For example, the dimensions of a 7"H×9"W×8.5"L discarded wooden cross tie 36 are in the first step reduced to form a core member with dimensions of 6.5"H×8.5"W×8'3"L. The removal of the outermost side 62*a*,62*b*, 62*c*,62*d* and end surfaces 64*a*,64*b* of the ties 36 may be effected by any number of manner, including by way of non-limiting examples, by removing side and end layers with a band saw, rotary saw blade, surface planer or by sanding. The applicant has found that most preferably, surface material is removed from each of the side surfaces of the recycled hardwood cross tie 36 by the use of a saw blade. The use of a saw blade advantageously leaves the newly exposed side surfaces with a roughened texture, which facilitates bonding with the outer coating layer 46.

Following removal of the chemically preserved side end surfaces, the bore holes 58 are formed in the ends 44*a*,44*b* of each core member 40. The bore holes 58 are formed at locations selected so that when the bosses 52 are positioned therein, the edge 59 of the end caps 42 substantially align with and extend a marginal distance beyond the edges of the ends 44. Optionally, once the end caps 42*a*,42*b* are secured to the respective core member ends 44*a*,44*b*, any excess end cap material could be trimmed flush with the end 44 by the use of a saw, sander, hot wire cutter or the like.

The end caps 42*a*,42*b* are secured to each end 44*a*,44*b* of the core member 40 by press fitting the bosses 52 into the corresponding complementary sized bore holes 58. Following the positioning of the end caps 42, the refurbished core members 40 are arranged in a longitudinally aligned end-to-end configuration. As shown best in FIG. 8, the core members 40 are positioned so that the end caps 42*a* of each core member 40 abuts the end cap 42*b* of a next refurbished core member 40. In this orientation, the refurbished core members may be moved as an array through an extruder 66 used to apply the coating 46.

Figure 8:
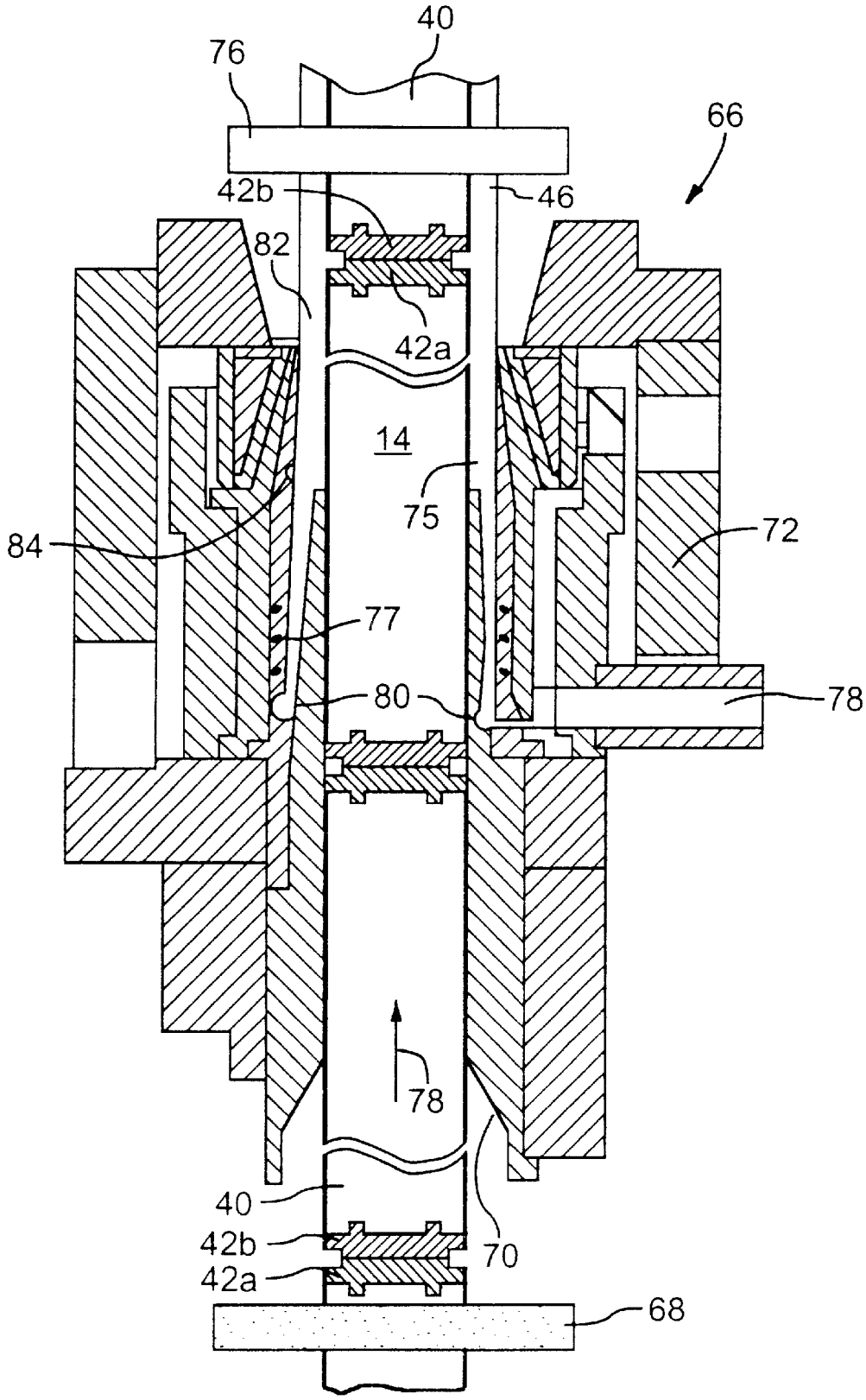
FIG. 8 shows a schematic top view of a crosshead die used in the manufacture of composite railroad cross ties in accordance with the present invention.

FIG. 8 shows the extruder 66 in top view as including serrated in feed rollers 68, rectangular feed bore 70, a cross head die 72 having a die opening 75, and a number of smooth out feed rollers 76. The feed bore 70 has a complementary profile to the core members 40 and a marginally larger cross-sectional dimension. The relative spacing between the feed bore and the core member 40 is selected to allow the infeed rollers 68 to move the aligned members 40 along the feed bore 70 in the direction of arrow 78 to the die opening 75 while substantially preventing the backflow of molten extrudate therebetween.

The cross head die opening 75 is generally rectangular in shape and surrounds the feed bore 70 at an upstream position. The cross head die 72 includes heaters 77 and an inlet passageway 78 for receiving thermoplastic material from a screw feeder (not shown). The passageway 78 connects to generally annular melt distribution channel 80. The distribution channel 80 is configured to maintain substantially even melt pressure along its length. The distribution channel 80 extends annularly about the feed bore 70 and to the die opening 75. Downstream from the die opening 75, the die 72 forms a shaping passage 82. The shaping passage is provided with a rectangular shape and forms the outer dimension of the finished railroad cross tie 14.

With the cross head die 72, molten thermoplastic extrudate flows generally helically about the feed bore 70 from the inlet passageway 78 of the die 72. As the aligned core members 40 are moved in the direction of arrow 78 along the feed bore 70, the thermoplastic extrudate emerges from the die opening 75 and is applied evenly over the longitudinal side surfaces 48*a*,48*b*,48*c*,48*d*, to form the outer coating 46. The melt distribution channel 80 can be slanted at an optimum angle and, in addition, can feature a progressive or digressive curve in order to optimize the melt distribution of the extrudate and pressure within the cross head die 72.

The heaters 77 used to heat the entry section and the melt distribution channel 80 of the die 72 may be cartridge heaters, or heating may be achieved with water or heat transfer oil. This will prevent the melt extrudate from premature cooling and increasing in viscosity, which would result in very high internal pressures and an uneven, coarse coating of the tie. The exit section or shaping passage 82 of the die 72 may not include heating elements. This permits the molten thermoplastic coating 46 which surrounds the core member 40 to cool. The cooling of the coating 46 will result in some shrinkage, easing the exit out of the cross tie 14 from the die 72.

The core members are arranged in an end-to-end configuration so that the end caps 42 secured to each adjacent core member 40 are aligned with each other with their outer surfaces 53 in abutting contact, substantially preventing the movement of the thermoplastic coating material therebetween. The serrated rollers 68 are used to push the array of core members 40 through the bore 70 and past the die opening 75. The serrations on the rollers 68 advantageously leave indentations along the sides 48*a*,48*b*,48*c*,48*d* which assist in the adherence of the coating 46 thereto.

In order to infill any cracks and spike holes in the core member 40, the plastic extrudate is preferably in liquid form and under moderate pressure as it moves from the distribution channel 80 and die opening 75 about the core member 40. The outer plastic coating 46 is applied in substantially the same thickness that the discarded wooden cross tie 36 (FIG. 3) was reduced in size, to maintain its original dimensions. For example, in a second step the plastic coating 46 is provided in a thickness of 0.4 to 20 mm on all of the core sides 48*a*,48*b*,48*c*,48*d*, resulting in the formed composite cross tie 14 having the same height and width dimensions as the original discarded wooden cross tie 36. Similarly, the end caps 42*a*,42*b* are provided with a thickness between surfaces 50 and 53, which corresponds to the average thickness of material removed from the cross tie ends 64*a*,64*b* (FIG. 3).

Since recycled ties 36 have some cracks and other imperfections, varying amounts of melted extrudate are required to coat the core member 40 evenly. This problem is overcome by installing a pressure sensor 84 within the cross head die 72. This sensor 84 will increase or reduce the speed of the serrated in feed rollers 68, whereby if more extrudate is necessary to fill cracks or holes within the core member 40, the core member will be fed through at a reduced speed. The speed is infinitely variable, so that the core member 40 could come to a complete stand still for a brief moment, until enough extrudate is provided from the die opening 75 to coat the member 40 completely and the pressure is built up to the required setting. Although not shown, to optimize the quality of this product, more than one pressure sensor can be built into the die 72.

FIG. 8 shows best the application of the molten thermoplastic extrudate not only over the longitudinal side surfaces 48 of the core member 40, but also over the abutting end caps 42. The extrudate is applied in an even layer of coating 46 which infills the recesses defined by the adjacent shoulders 54 of abutting end caps 42*a*,42*b*. The infilling of the shoulders 54 by the coating 46 acts to further seal and secure the end caps 42 in position over the respective ends. In addition, the chamfered edge 59 of the end caps 42 increases the surface area of the meltable portion of the end cap 42 to which the molten extrudate may bond. Although not shown, if desired, the end caps could be provided with double side chamfered edges to provide still increased bonding area. Following the emergence of the coated railway ties 14 from the die 72, the individual cross ties 14 are separated by either cutting, tearing or otherwise fracturing at the joints where the surfaces 54 of the end caps 42*a*,42*b* abut each other. Although not essential, a clear or semi-transparent coating may be provided to assist in the separation of joined cross ties 14 at the desired location.

If necessary, once the thermoplastic or thermosetting resin coating 46 has cured or solidified, the composite railway tie 14 may be sized. For example, the railroad cross tie 14 may be trimmed to a final dimension by passing through a cutting machine or hot wire trimmer (not shown) to finish the composite cross tie 14 to a preferred size. For practical and economical reasons, the thickness of the cured coating 46 is selected most preferably at between 0.4 mm and 20 mm. Below minimum thicknesses, the rejection rate during production due to incomplete coverage and infilling of recycled wooden core members 40 (non-totally encapsulated cross ties) may be too high. With increased thicknesses, the mechanical strength of the composite cross tie may be compromised. In addition, with increased coating thickness, plastic material costs and the resulting lengthened cooling or curing cycle times may be cost prohibitive.

It is to be appreciated that the use of the end caps 42 advantageously avoid the necessity of using large volumes of molten thermoplastic material to ensure complete sealing of the core member ends 44*a*,44*b*. The inventors have appreciated that larger volumes of molten extrudate would require increased cooling and curing times, lessening manufacturing efficiencies. Again, because the coating 46 extends along the longitudinal side surfaces 48 of the core member 40, and partially over each end at the end cap shoulder 54, the thermoplastic coating 46 advantageously assists in maintaining the end caps 42*a*,42*b* of the cross tie tightly secured to the core member ends 44*a*,44*b* and in sealing contact therewith. In addition, because the completed composite railroad cross tie 14 has a wooden core member 40 which is substantially encapsulated by the end caps 42 and outer coating 46, the degradable portion of the cross tie 14 is isolated from the environment and pests, prolonging its expected life span.

Although the end caps 42 are disclosed as being formed from a thermoplastic material corresponding to that of the coating, the invention is not so limited. If desired, end caps made from other types of plastics, fibers, composites, metals or the like could also be used. The end caps 42 could also include protruding pins, metal members or the like to assist in locating the end surfaces 30,32 of the extruded ties 14. In addition, the end caps 42 may contain fillers or other substances or implants of metallic or otherwise detectable material, in order to be able to trigger a signal for the separation operation. The contact surface 50 could also be provided with a metallic coating or layer to provide still enhanced resistance to boring insects. Thermoplastic end caps are, however, believed desirable in that they permit good bonding between the molten coating material and enable the cross tie to be sized to a final dimension if desired.

While the use of the end caps 42 advantageously simplifies cross head die extrusion molding of the composite railway cross tie 14, other molding technologies such as injection molding, intrusion, compression or blow molding technologies may be applied for the encapsulation of the core and/or end caps. When thermosetting resins are used to form the coating, such as polyurethanes, the conventional RIM process may be applied. The actual wet thickness of the plastic coating will be determined by the properties of the plastic material and the processing process used (e.g. injection vs. compression molding or extrusion) and the actual flow properties of the material to securely fill all the holes and cracks. Generally speaking standard blow molding techniques, using high viscosity materials and low pressure will require thicker plastic wall sections than polyurethane RIM with very low viscosity at the processing stage.

It is to be appreciated that the use of recycled railway ties to form the core member 40 advantageously minimizes disposal problems associated with the replacement of existing hardwood rail ties 36 (FIG. 3). In order to get the best adhesion between the plastic outer coating 46 and the core member 40, it may be desirable that the side surfaces 48 and ends 44 of the core member 40 are not too smooth. Therefore discarded railway cross ties 36 having cracks and holes 60 are one of the preferred core materials.

As the outer coating 46 is applied to the wooden core member 40 in a thickness so that when cured or solidified, the composite railroad cross tie 14 has substantially the same overall dimensions and shape as the discarded hardwood cross tie 36, the present invention is particularly suited for repairing existing railway lines. In particular, the cross ties 14 of FIG. 1 may be readily positioned within the impressions left in the gravel ballast 12 upon the removal of any decayed or rotting creosote preserved hardwood ties. This avoids the need of adding or significantly redistributing ballast and simplifies rail line repair. It is to be appreciated that because the least required amount (preferably less than about 3 cm) of material is removed from any one side of the recycled hardwood cross tie 36, the resulting wooden core member 40 has a sufficient cross-sectional dimension to receive and support conventional rail spikes used to maintain the rails in position on the rail bed.

While FIGS. 1 to 5 illustrate a cross tie in which the outer coating 46 is applied to core member 40 in the same average thickness to each of side surfaces, the invention is not so limited. The outer coating 46 could also be applied to the top and bottom side surfaces 48*a*,48*b* of the core member 40 in a thickness approximately two to three times the thickness of the coating as applied to the front and back side surfaces 48*c*,48*d*, or with the coating 46 thicker over the front and rear surfaces 48*c*,48*d*.

While the formation of the end caps 42 as a modular element for use on either end 44 of the core member 40 advantageously reduces manufacturing costs, the invention is not so limited. If desired, separate end cap elements could be used which, for example, are adapted for contact in a male/female fit to minimize the introduction of the thermoplastic coating therebetween, and facilitate the separation of cross ties 14 following their emergence from the cross head die 72. Similarly, while the preferred embodiment discloses the end caps 42 as having a peripherally extending shoulder 54 which is engaged by the coating 46 to assist in its retention to the core member 40, the shoulder 54 may be omitted in its entirety, or other openings or recesses, indentations and/or recesses may be provided into which the molten thermoplastic material may flow to assist in maintaining the core member 40 sealed from the environment.

Figure 9:
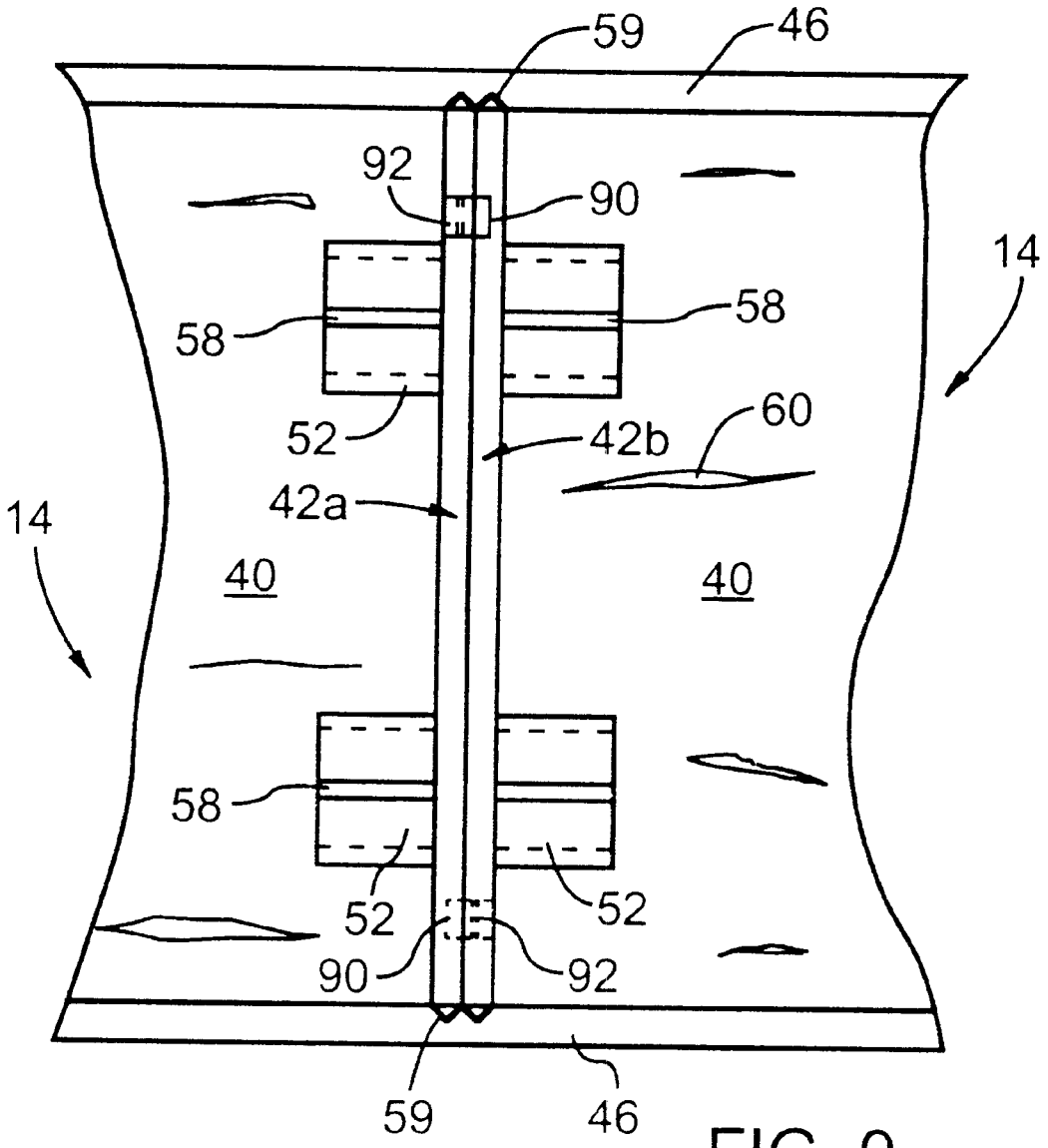
FIG. 9 shows a schematic side view of the abutting placement of the end caps in accordance with a further embodiment of the invention as the cross ties emerge from the die of FIG. 8.

FIG. 9 shows the abutting placement of two cross ties 14 having a modified end cap 42 in accordance with a further embodiment of the invention, and where like reference numerals are used to identify like components. Each end cap 42*a*,42*b* of FIG. 9 is provided with cylindrical locating recesses 90 and pins 92 which are configured to engage respective recess 90 and pin of the other adjacent end cap. The engagement of the recesses 90 and pin 92 operate to ensure the correct alignment of the core members 40 as, for example, when they are moved through the extruder of FIG. 8. The end caps 42*a*,42*b* of FIG. 9 provide a simplified construction in that the shoulder 54 is omitted. While FIG. 9 shows a cylindrical pin and recess arrangement, it is to be appreciated that other configurations are also possible, including by way of non-limiting example, the use of tabs, slots or the like. The end caps 42 may also feature further serrations to further increase the melt bonding during the process.

While the end cap 42 is described as having a peripheral dimension corresponding to that of the core ends 44 to facilitate the movement of the core member 40 through the die bore 72, in a less preferred embodiment, the end cap 42 could be formed with a larger or smaller dimension from the cross-sectional dimension of the core member 40.

The use of recycled railway ties to form the wood core 40 is particularly advantageous, as the hardwood will have typically already undergone numerous years of drying, and therefore will be less susceptible to further member shrinkage and cracking than a virgin or green wood core. Although the use of a wood core made from a recycled rail tie is most preferred, the invention is not so limited. If desired, the core member could be formed from other virgin woods, concrete, plastics or engineered wood products, including by way of non-limiting examples plywood, oriented strand board (OSB) and micro laminated wooden beams.

The combination of an economically produced core member 40 made from natural or manmade wood sealed by end covers or caps 42, and a coating 46 made from virgin or recycled plastic compounds offers both longevity in the most severe climatic conditions and insect infested areas, as well as the necessary low creep, stability and mechanical properties attributed to wood.

While the preferred embodiment of the invention describes the use of end caps 44*a*,44*b* in the cross tie 14 formation, the invention is not so limited. If desired, the number of core members 40 could be moved through the cross head die 72 in a spaced apart end-to-end configuration, and the melt extrudate used to encapsulate the entire core member 40. In manufacture, the extrusion process could pause as each end 44*a*,44*b* moves past the die opening 75 to ensure complete infiling of any spacing between adjacent members 40. Following movement from the die 72, the cross ties could thereafter be separated by sawing or hot wire cutting.

Alternately, in another mode of manufacture, the core members 40 could be placed in direct end-to-end abutting contact and moved through the cross head die 72. Following the application of the outer coating 46, adjacent core members 40 are separated after which the end caps 42*a*,42*b* are secured in place over each end 44*a*,44*b*, as for example by mechanical or chemical fasteners, or by sonic welding or the like.

While the rectangular shape of the hardwood core is preferred, cores having different shapes and configurations are also possible and will now become apparent.

Although the preferred embodiment of the invention discloses polyolefin as a preferred thermoplastic coating material, other thermoplastics, thermosetting resin and/or rubber materials may also be used to form the coating and/or the end caps.

While the detailed description describes creosote as the preservative used to chemically treat hardwood cross ties, it is to be appreciated that logs treated with other types of chemicals including arsenic and other heavy metal based compounds may also be used to form the core member with the present invention.

Although the disclosure describes and illustrates various preferred embodiments, the invention is not so limited. Many modifications and variations will now occur to a person skilled in the art. For a definition of the invention, reference may now be had to the appended claims.

I claim:

1. A method of manufacturing a composite railroad cross tie using an extrusion die having an axially extending feed bore, a generally rectangular die opening aligned with said feed bore, and an extrudate distribution passage communicating with said die opening, the railroad cross tie characterized by:

a generally rectangular inner wooden core member having a longitudinally elongated side surface extending from a first core member end to a second core member end, an end cap member in sealing engagement with said first core member end, and a coating layer substantially bonded to said side surfaces, wherein said cross tie is formed by:

securing said end cap member to said first end, and moving said core member together with said end cap member axially through said feed bore and past said die opening while extruding molten extrudate from the distribution passage into the die opening and about the side surfaces of the core member, and wherein said extrudate is selected from a thermoplastic, thermosetting resin and mixtures thereof, and wherein the end cap member includes a peripherally located recess, whereby during the step of moving the core member through the die cavity, extruding the molten extrudate at least partially into said recess to assist in maintaining said end cap member in engagement with said first one of said ends.

2. The method of claim 1 wherein said railroad cross tie further comprises an end cap member in substantially sealing contact with the second other end of the core member, and said core member is moved through said feed bore and cavity as part of an array of longitudinally aligned core members positioned with adjacent end cap members in a substantially abutting end-to-end configuration.

3. The method of claim 2 wherein following movement of said array of aligned core members from said die cavity, separating the ties at the point of abutting contact of said end cap members.

4. The method of claim 2 wherein each of the end cap members include contact surfaces which when positioned in abutting contact, substantially prevent movement of the molten extrudate resin therebetween, and when said array of core members is moved through said die cavity, maintaining the contact surfaces of adjacent end cap members in abutting contact.

5. The method of claim 1 wherein the die opening has a generally rectangular cross-sectional profile marginally greater than a lateral cross-sectional profile of the core member, and said feed bore has a dimension selected to substantially prevent upstream movement of said molten extrudate from said die opening therein.

6. The method of claim 1 wherein the core member comprises part of a recycled hardwood railroad tie, and prior to the step of securing said end cap member, refurbishing said recycled hardwood railroad tie by removing chemically treated side surfaces of said hardwood railroad tie to a depth of between about 0.4 mm and 20 mm.

7. The method of claim 1 wherein said recess extends substantially about the periphery of said cover member.

8. The method of claim 1 wherein the end cap member includes a projecting engagement member, prior to said step of securing said end cap member, forming a bore in said first core member end sized to receive said engagement member therein.

* * * * *